US007093541B2

(12) United States Patent
Herbelin

(10) Patent No.: US 7,093,541 B2
(45) Date of Patent: Aug. 22, 2006

(54) ENHANCEMENT OF SOLID EXPLOSIVE MUNITIONS USING REFLECTIVE CASINGS

(75) Inventor: John M. Herbelin, Albuquerque, NM (US)

(73) Assignee: Applied Research Associates, Inc., Albuquerque, NM (US)

( * ) Notice: Subject to any disclaimer, the term of this patent is extended or adjusted under 35 U.S.C. 154(b) by 0 days.

(21) Appl. No.: 10/606,827

(22) Filed: Jun. 27, 2003

(65) Prior Publication Data

US 2004/0055497 A1 Mar. 25, 2004

Related U.S. Application Data

(60) Provisional application No. 60/394,662, filed on Jul. 10, 2002.

(51) Int. Cl.
*F42B 10/00* (2006.01)

(52) U.S. Cl. ..... 102/475; 102/430; 102/201

(58) Field of Classification Search ..... 102/475, 102/430, 201
See application file for complete search history.

(56) References Cited

U.S. PATENT DOCUMENTS

| | | | | |
|---|---|---|---|---|
| 2,892,407 | A * | 6/1959 | Macleod | 102/309 |
| 3,741,123 | A * | 6/1973 | Dittrich | 102/491 |
| 4,010,690 | A * | 3/1977 | Cocozella et al. | 102/282 |
| 4,267,526 | A | 5/1981 | McDermott et al. | |
| 4,342,116 | A | 7/1982 | MacKnight et al. | |
| 4,653,062 | A | 3/1987 | Davis et al. | |
| 4,866,729 | A | 9/1989 | Verdier et al. | |
| 4,891,815 | A | 1/1990 | Ragle et al. | |
| 4,917,014 | A * | 4/1990 | Loughry et al. | 102/201 |
| 4,961,200 | A | 10/1990 | Verdier et al. | |
| 5,036,767 | A * | 8/1991 | Folsom et al. | 102/201 |
| 5,052,011 | A | 9/1991 | Piltch et al. | |
| 5,148,748 | A | 9/1992 | Yarrington | |
| 5,212,339 | A * | 5/1993 | Piltch | 102/202 |
| 5,417,928 | A | 5/1995 | McDermott | |
| 5,802,095 | A | 9/1998 | Schall | |
| 5,870,422 | A | 2/1999 | Florentino et al. | |
| 5,883,916 | A | 3/1999 | Lohn et al. | |
| 5,974,072 | A | 10/1999 | Hartlove et al. | |
| 6,154,478 | A | 11/2000 | Vetrovec | |
| 6,212,989 | B1 | 4/2001 | Beyer et al. | |
| 6,276,276 | B1 | 8/2001 | Erickson | |
| 6,377,600 | B1 | 4/2002 | Flegal | |
| 6,523,475 | B1 * | 2/2003 | Smalley et al. | 102/430 |
| 6,832,556 | B1 * | 12/2004 | Smalley, Jr. | 102/430 |
| 2001/0033597 | A1 | 10/2001 | Neumann | |
| 2002/0067753 | A1 | 6/2002 | Ullman et al. | |

* cited by examiner

*Primary Examiner*—M. Clement
(74) *Attorney, Agent, or Firm*—Jacobson Holman PLLC

(57) ABSTRACT

A solid explosive munition casing for an explosive charge, the inner surface of the casing including a material that is highly reflective in the optical and infrared spectrum. Through this reflectivity, electromagnetic radiation generated by the detonation process is redirected back into the interior of the munition to increase its explosive output.

10 Claims, 8 Drawing Sheets

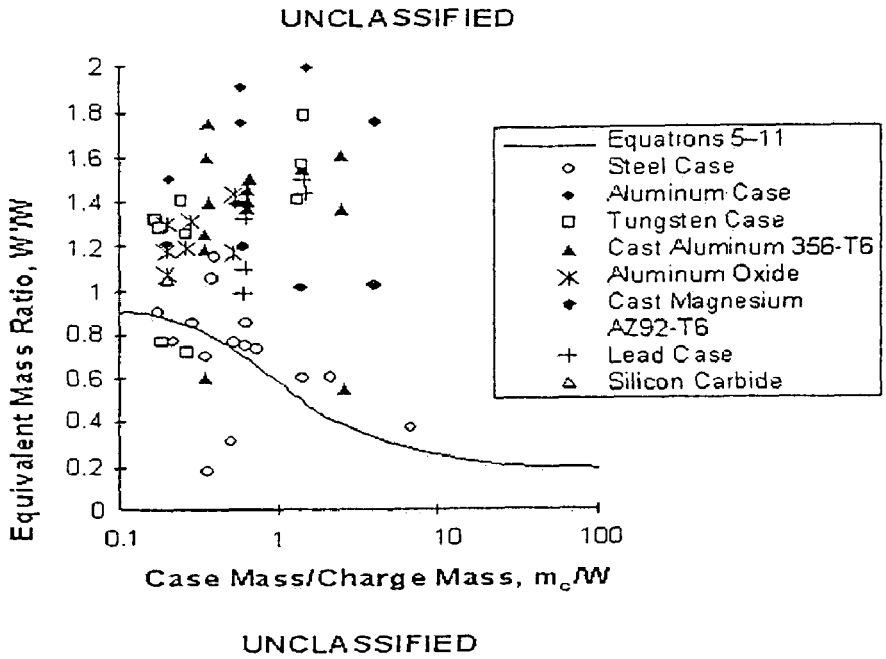
FIG. 1
FIG. 2A
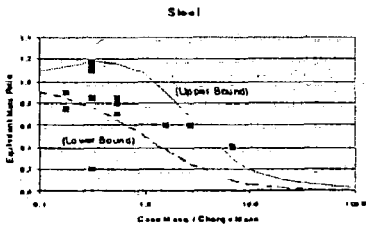
FIG.2B
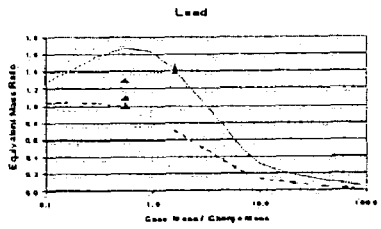
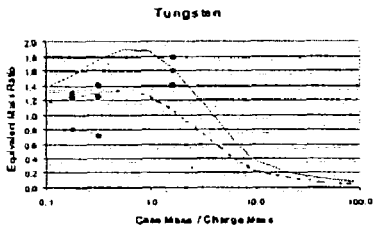
FIG. 2C
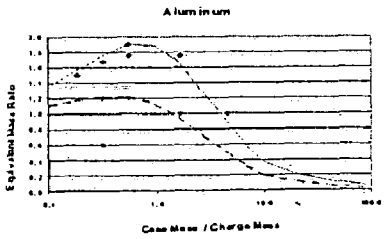
FIG.2D

ENHANCEMENT OF SOLID EXPLOSIVE MUNITIONS USING REFLECTIVE CASINGS

This is a complete utility application entitled to the priority and claiming the benefit of U.S. provisional application Ser. No. 60/394,662 filed Jul. 10, 2002.

BACKGROUND OF THE INVENTION

1. Field of the Invention

The present invention is related to the field of munitions and, more particularly, to improved munitions design reflective casing constructions for solid explosive munitions demonstrating improved performance characteristics.

2. Description of the Related Art

Historically, the radiation that accompanies chemical reactions, such as the detonation of high energy explosive munitions, has been treated as an incidental, minor release of energy. Furthermore, explosive munitions have traditionally been made using highly absorbing, low reflecting materials such as tar, asphalt-like substances or black polymers to line the casings and cushion the munition.

It is known that high energy devices that vary in their casing size and material composition have different performance characteristics. FIG. 1, taken from the Design and Analysis of Hardened Structures (DAHS) Manual for case charges, summarizes prior art experimental evidence in which test results obtained for different casing materials were evaluated in terms of Equivalent Mass Ratio (EMR). Equivalent mass ratio is defined as W' divided by W, where W is the amount of explosive, such as TNT, in an encased sample and producing a given blast effect, and W' is that corresponding amount of TNT which would be required to produce the same blast effect in an open air detonation, i.e., without a casing.

In FIG. 1, relative performance in terms of the equivalent mass ratio is plotted as a function of the ratio of the casing mass, mc, to the charge mass, W. As shown, different casing materials yield different equivalent mass ratios, because different casing materials enhance the explosive effect of the encased explosive (e.g., TNT) to differing degrees over the bare charge performance of EMR=1.

The data presented in FIG. 1 illustrates that for steel, the equivalent mass ratio decreases with increased case mass relative to the charge mass, whereas for the other materials tested there is a substantial increase in EMR, with each material reaching a different maximum value. Aluminum, for example, demonstrates an enhancement of more than 100% over the steel casing performance at a case mass/charge mass ratio that is greater than unity. However, as the basis for these differences in performance enhancement had not been fully understood, it was difficult or impossible to utilize these observed enhancements in the design of explosive munitions. Consequently, they have for the most part been ignored or discounted in all of the past and current designs of munitions to accomplish selected tasks.

SUMMARY OF THE INVENTION

In view of the foregoing, one object of the present invention is to enhance the output of solid explosive munitions through improved selection of new casing materials and linings.

Another object of the present invention is to improve solid munitions performance through the use of reflective material on the inner wall (surrounding the explosive) of the munition casing.

A further object of the present invention is to reduce the amount of explosive that is necessary within an encased munition to produce a given blast effect.

Another object is to provide a directional nature to the blast phenomena that can be made to optimize the effects in the intended direction while reducing the collateral damage in other directions.

Yet another object of the present invention is to produce solid explosive munitions having increased equivalent mass ratios.

In accordance with this and other objects, the present invention is directed to the casing for a solid explosive munition. The inner surface of the casing is shaped to provide an unobstructed view of the charge and is made of a material that is highly reflective (non-absorbing) in the optical and infrared spectrum. Through this reflectivity, electromagnetic radiation generated by the detonation process is redirected back into the interior of the munition where it further enhances the detonation processes. This increased radiation field causes two primary effects. Firstly, the time-rate of conversion of internal molecular energy into kinetic energy is enhanced by means of stimulated absorption and emission processes and, secondly, that portion of the radiation that is no longer absorbed by the casing is available to be absorbed by the shocked heated air surrounding the munition, resulting in enhanced air blast impulse.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a graph taken from a prior art manual which illustrates equivalent experimental charge masses for various casing materials;

FIGS. 2A–2D are graphs individually setting forth casing data for specific casing materials;

DETAILED DESCRIPTION OF THE PREFERRED EMBODIMENTS

Figure 3:
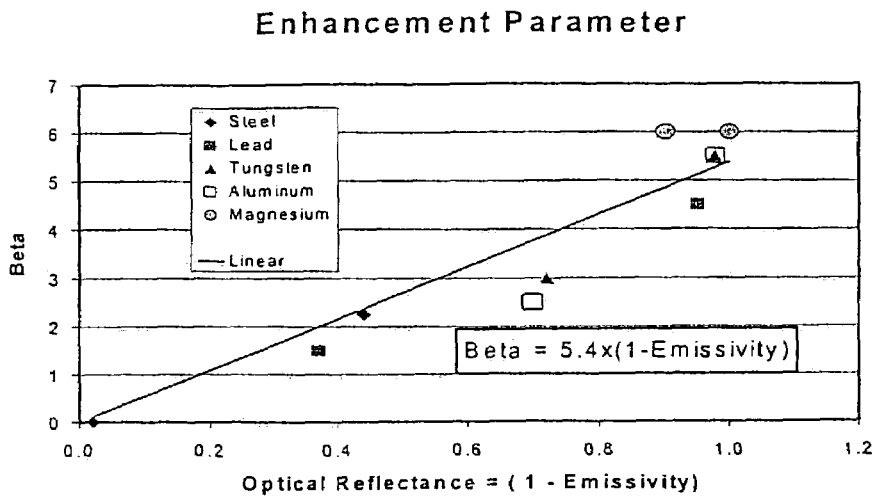
FIG. 3 is a graph illustrating the correlation of the enhancement factor to the optical reflectance of the casing materials.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose.

As previously discussed, the data in FIG. 1 illustrates the relative performance improvement in terms of the equivalent mass ratios of various casing materials, as a function of the ratio of the casing mass to the charge mass. While this data indicates the desirability of using particular casing materials, as opposed to other alternative materials, the basis for the differences in performance have not been fully characterized.

In development of the present invention, the data of FIG. 1 was segregated according to specific casing material, as shown in FIG. 2A (steel), FIG. 2B (lead), FIG. 2C (tungsten) and FIG. 2D (aluminum) The solid lines and the dashed lines represent the upper and lower bounds, respectively, of the EMR data (W'/W) that were generated from the following expression, $$W'/W=[W/W_T]\{1+\beta(W_c/W_T)\}$$

$W_X$ is the mass of the charge, WC is the mass of the casing, and $W_T$ is the total mass of the charge and the casing. The first term, $W/W_T$, corresponds to the "usual" performance reduction that results from the added mass of the casing, while the second term contains an enhancement factor that is proportional to the mass fraction of the casing, $W_C/W_T$. The proportionality constant, β, is adjusted to produce the upper and lower bounds shown; thus, for each material, two values were obtained. (The upper and lower bounds are intended to encompass the vast majority of data points; some judgment was used in discarding extreme data points.)

Efforts were undertaken to correlate the deduced values to any one of several material properties ranging from tensile strength to ionization potentials, none of which were successful. However, based on the inventor's experience with laser systems and their sensitivity to the emissivity of the walls, testing was initiated to determine a possible correlation between β and the optical reflectance (1-emissivity) of the casing materials.

FIG. 3 is a graph depicting the results of plotting the upper and lower bound of β with the corresponding upper and lower bounds of optical reflectance, (1-ϵ), where ϵ is the emissivity of the corresponding material, i.e., steel, lead, tungsten and aluminum. As shown, there is a linear relationship between the enhancement factor and the optical reflectance of the casing materials, i.e., the higher the reflectivity of the inner wall of the casing, the greater the performance output of the explosive munition. In a subsequent section additional evidence of the nature of this enhancement will be presented.

Figure 4A:
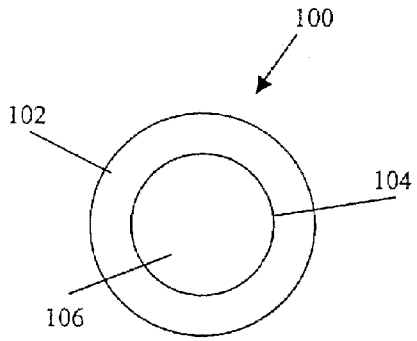
FIG. 4A is a cross-section of a first preferred embodiment of the reflective casing for a solid munition in accordance with the present invention.
Figure 4B:
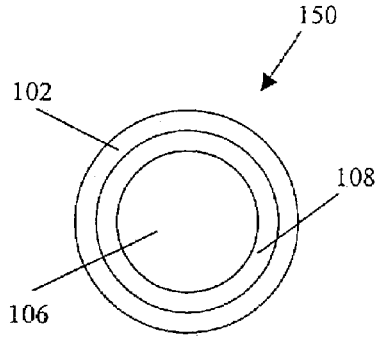
FIG. 4B is a cross-section of a second preferred embodiment of the reflective casing for a solid munition in accordance with the present invention.

The present invention, therefore, is directed to an explosive munition such as that representatively illustrated in FIGS. 4A and 4B. The munition, generally designated by the reference numeral 100, includes a casing 102 having an interior surface designed to include a broadband, highly reflective surface 104 surrounding a primary charge 106. The reflective surface 104 has an unobstructed exposure or view of the primary charge 106, or is in direct contact therewith, resulting in substantially increased explosive performance of the munition 100.

The reflective surface 104 may be integral with the casing, or may be embodied as a reflective paint or other liquid applied to the inner surface of the casing, as shown in FIG. 4A. It is also possible to apply the reflective liquid to the primary charge 106 itself.

Figure 4C:
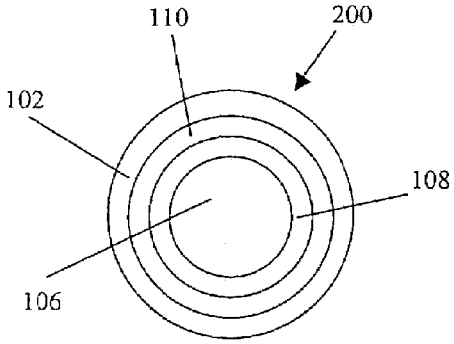
FIG. 4C is a cross-section of a third preferred embodiment of the reflective casing for a solid munition in accordance with the present invention.

The reflective surface may also be embodied as a separate liner element 108 within a munition 150, as shown in FIG. 4B. With the liner element 108, the munition 200 may further include a shock-absorbing layer 110 of polymer or asphalt-like material, between the liner and the casing wall, which is used to cushion the primary charge 106, as shown in FIG. 4C. As a further embodiment, the shock-absorbing layer 110 may be painted with a liquid reflective material such that the separate liner element 108 is not needed.

The reflective surface 104 or liner 108, which is referred to generally herein as the optical reflecting layer, may include sheeting of a highly reflective metal, such as aluminum, ceramic material, plastic or a combination of such components, provided the resulting material is able to retain its broadband reflectance properties. For example, the optical reflecting layer may be a plastic coated with a highly reflective material such as a thin coating of aluminum or dielectric material. Other suitable materials for the reflecting layer include lead, steel, tungsten, nickel and gold. The thickness of the optical reflecting layer may be adjusted to accommodate a variety of munition casing designs, but must be sufficiently durable to stay intact until the fracture of the casing structure.

Figure 4D:
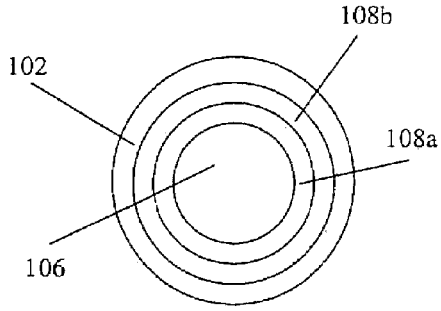
FIG. 4D is a cross-section of a fourth preferred embodiment of the reflective casing for a solid munition in accordance with the present invention.

Multiple optical reflecting layers 108*a*, 108*b*, as shown in FIG. 4D, may be applied to the casing in concentric or adjacent cylinders, cubes or spheres, consistent with the shape of the device so as to provide for optimal performance thereof. The separations between the added optical reflecting layers are guided by the optical thickness of the explosive material to achieve the maximum distribution of the electromagnetic radiation. Detonation of the explosive in the inner concentric cylinder would result in the rapid buildup of radiation due to the close proximity of the reflecting walls. As the detonation proceeds and ruptures reflecting wall 108*a*, the radiation escapes into the next larger concentric cylinder and is instantly available to augment the reaction chemistry and energy release. The exact separation of these concentric reflectors depends upon a variety of variables such as the optical thickness of the parent explosive. The technique is analogous to, but distinct from, the oscillator/amplifier technique used in lasers. The actual spacing yielding the maximum enhancement is expected to vary from explosive to explosive. The approach is being presented as a means to circumvent any optical thickness limits that may be present in some explosives or mixtures of explosives.

The shape of the optical reflecting layer or layers should be such as to enhance the return of electromagnetic radiation to the detonating explosive. Spherical, cylindrical and cubical shapes can be combined in a variety of ways to provide the desired optical containment, as can be verified by simple geometrical optical ray tracing techniques. Convex surfaces should be avoided as these have the effect of diffusing the radiation.

Figure 4E:
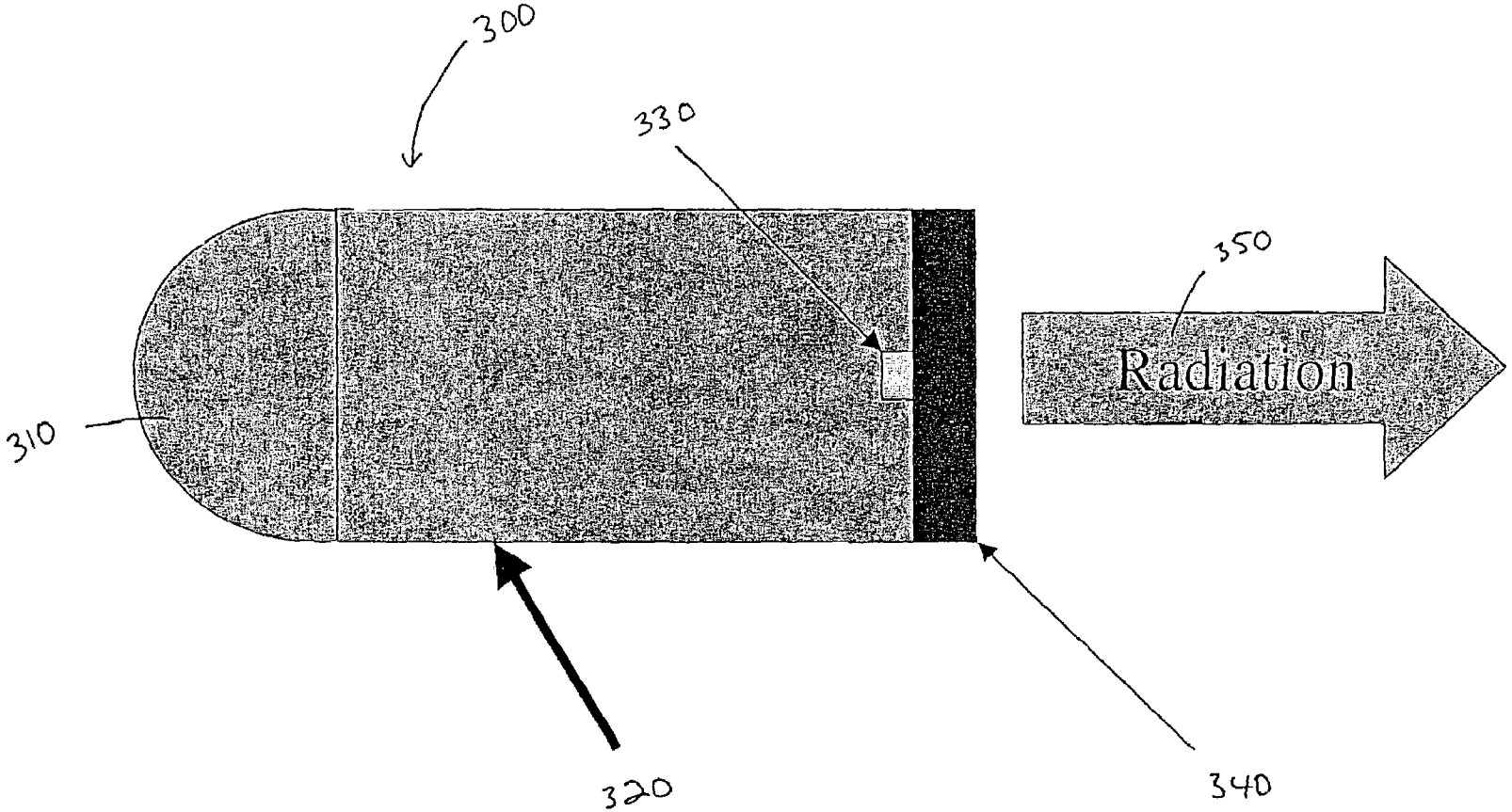
FIG. 4E is a cross-section of a fifth preferred embodiment of the reflective casing for a solid munition incorporating multiple optical reflecting layers, in accordance with the present invention.

The reflecting surfaces can also be designed to direct the radiation in one particular direction to localize and intensify the air blast phenomena. An example of this would be a semi-spherical reflective casing 300 having a reflecting end 310 connected to a reflector-lined steel cylinder 320, as shown in FIG. 4E. The initiator 330 is located next to a blow out plate 340 made of light-weight material, e.g. aluminum. Once initiated, the blast will quickly remove the blow out plate 340 and begin distorting the cylinder to a conical shape. This will form an unstable resonator that will direct the radiation 350 along the axis to the right in the figure and enhance the blast effect in that direction.

Figure 5A:
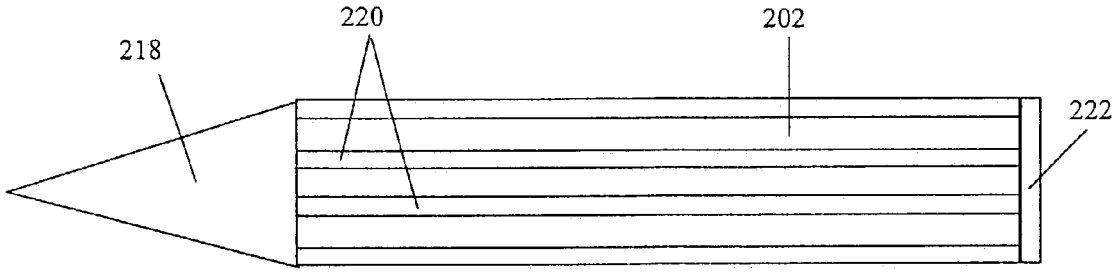
FIG. 5A is a side view of a reinforced aluminum casing with a steel penetration head, in accordance with the present invention.
Figure 5B:
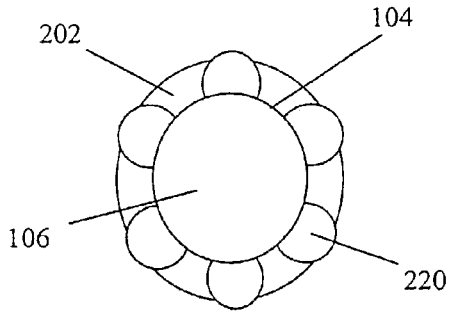
FIG. 5B is a cross-sectional view of the casing of FIG. 5A.

The reflective casing according to the present invention may also be constructed with a combination of components in a reinforced configuration such as is shown in FIGS. 5A and 5B. This embodiment includes a casing wall 202 reinforced with longitudinal members 220 of another, typically stronger, material. The longitudinal members 220 extend from a base element 222 to a penetration head 218 and are radially spaced along the casing wall 202. As one preferred embodiment, the casing wall 202 is aluminum, and the longitudinal reinforcement numbers 220 and head 218 are made of steel, such that this embodiment combines the increased air blast effects of aluminum in the casing with the structural properties of strength and weight provided by steel for increased target penetration.

In operation, the broadband, optical reflecting layer adjacent the charge enhances the build up of radiation generated by both spontaneous and stimulated emission processes during the detonation of the solid munition. The enhanced electromagnetic radiation field causes molecular changes, i.e., increased effective molecular volumes, as well as the rapid redistribution of the internal energy of the molecules of the combustion products via Raman scattering and related optical processes. All of these changes substantially enhance the energy-to-work conversion. We will show additional evidence of this increased energy conversion in the following sections.

With the reflective inner-wall casing design according to the present invention, substantial performance enhancements, on the order of 100% or greater, can be realized with current explosive munitions.

As set forth in connection with the specific munitions embodiments of the present invention, energy transfer processes occurring in gas phase kinetic energy transfer processes are closely coupled with the ambient radiation fields. This coupling can be enhanced or moderated via the configuration (placement and shape), composition (reflectivity) and condition (temperature) of the containment walls. The kinetics are the controlling factors in chemical munitions; therefore it stands to reason that the careful control of these reaction processes via the proper design of the container walls should make it possible to alter the rate and manner of energy release and therefore the performance of these reaction systems.

The present invention is built upon specific proprietary physical/mathematical models used to quantitatively describe the interaction of radiation with gas phase energy transfer process. These models include a radiation model, the basic physics of which can be best represented by the following simplified, chemical kinetic expression;

$$A^*+B+\Phi(\nu) \Leftrightarrow A+B+2\Phi(\nu) \quad (1)$$

Figure 6:
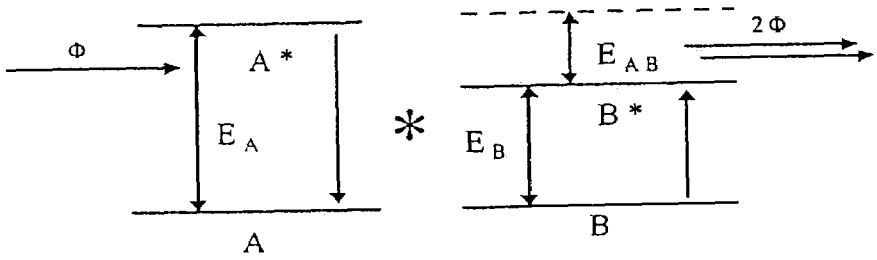
FIG. 6 is an energy diagram for a typical energy transfer process.

A* is the donor atom or molecule, being initially in an upper excited state (electronic, vibrational, rotational or translational excitation). Its partner, B, is a receptor atom or molecule in a lower energy state. The term $\Phi(\nu)$, represents the ambient radiation field at the frequency, ($\nu$), corresponding to the energy difference between the excitation energies of the interacting states, (A*–A) and (B–B*). In FIG. 6, an energy diagram of these interacting systems is presented which elucidates the relationship between the energy levels and the photon energy.

As indicated by Equation (1), radiation is both required and produced (in the exothermic direction) during this energy transfer process. This is a totally, unique aspect of the inventive approach underlying the present invention. Other theories assume that photons are not involved or, at most, are simply bi-products of the chemical reaction processes. In contrast, our premise is that the radiation fields at the frequencies indicated in Equation (1) are the controlling factors in the energy conversion processes.

Evidence supporting the general nature of this radiation enhancement phenomena can been found through comparison of the well-documented experimental measurements of the pressure, arrival time and impulse from a spherical, bare charge of TNT (Kingery and Bulmash), with the predictions of these same properties using the well-documented SHAMRC hydro-code, combined with the equally well-documented, Jone-Wilkin-Lee (JWL) equation of state (EOS).

Figure 7A:
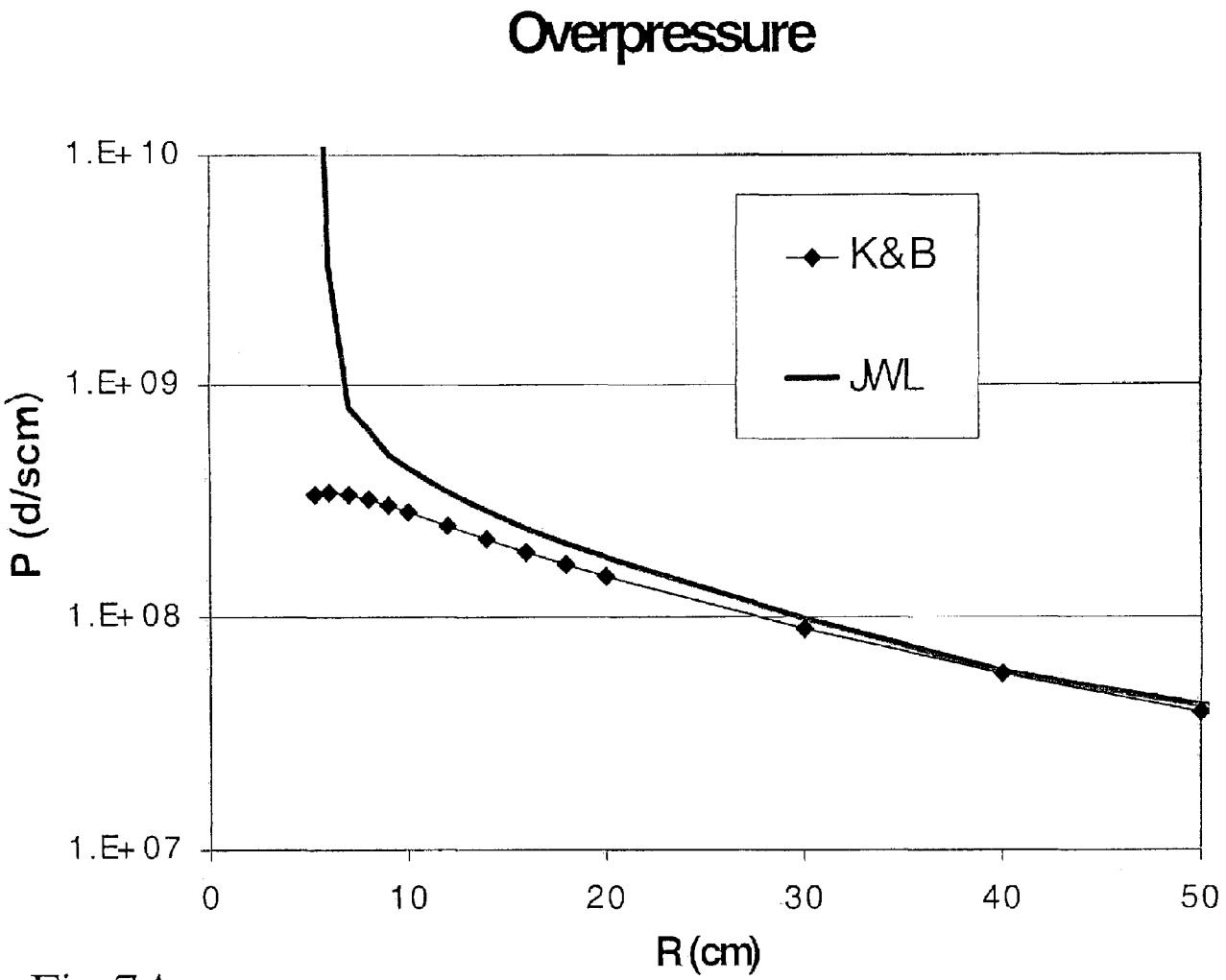
FIG. 7A is a graph showing the predicted large enhancement of the overpressure using SHAMRC/JWL versus the experimental (Kingery and Bulmash)
Figure 7B:
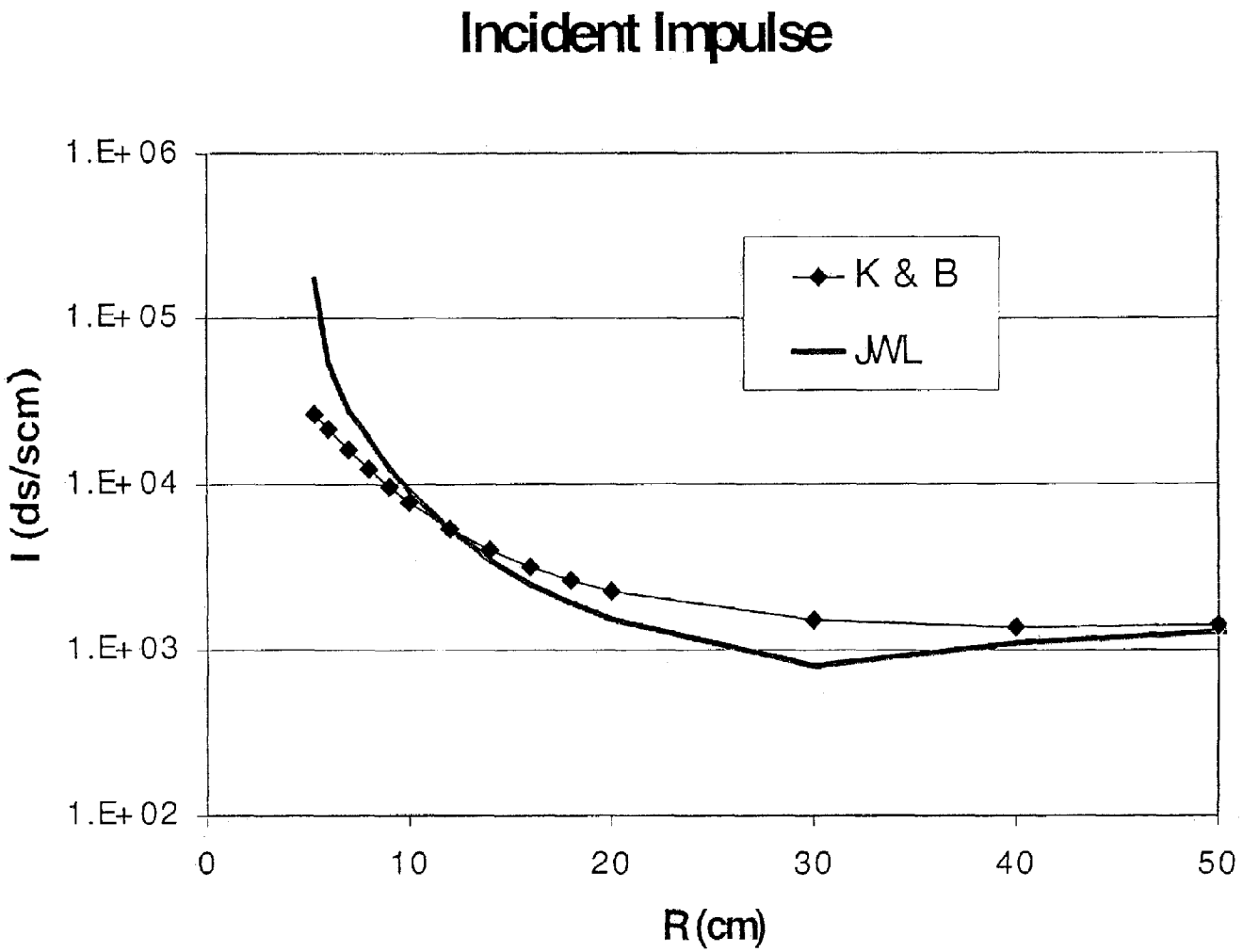
FIG. 7B is a graph showing the predicted large enhancement (at very short ranges) of the incident impulse using SHAMRC/JWL versus the experimental data (Kingery and Bulmash)

The JWL is an empirical EOS that is developed for each individual explosive by an iterative comparison with the experimental data derived from copper cylinder tests of that explosive. The essence of this experiment is to track the motion of the copper walls in close contact with the cylindrical charge of explosive during the detonation. The actual determination of the EOS is an iterative process utilizing a hydro-code, such as ARA SHAMRC code, to reproduce the motion of the walls. Consequently, the accuracy of this EOS should be best at small ranges. However, this is precisely where the largest discrepancy between the experimental and predicted air-blast data is found, as depicted in FIG. 7A for overpressure and in FIG. 7B for impulse as a function of range. The predicted impulse using the JWL EOS is over an order of magnitude greater than the observed air blast impulse. This discrepancy is far beyond any possibility of experimental error and has remained an issue of contention between investigators for many years.

The explanation of this discrepancy, and the demonstration of the importance of the radiation phenomena, lies in the fact that the walls used in these cylinder tests were made, of polished copper, which had appreciable reflectivity in the infrared region of the spectrum. This reflectivity enhances the rapid build-up of the radiation of Equation (1) that facilitates the conversion of the stored vibrational energy into both kinetic energy and radiation which is subsequently absorbed by the surrounding gas. In contrast, absorbing walls would inhibit the radiation build-up. Consequently, the predicted impulse, based upon an empirical EOS that used reflecting walls, would be expected to over-predict both the pressure and the impulse at short ranges of a bare charge. This is precisely the observed behavior.

Figure 8:
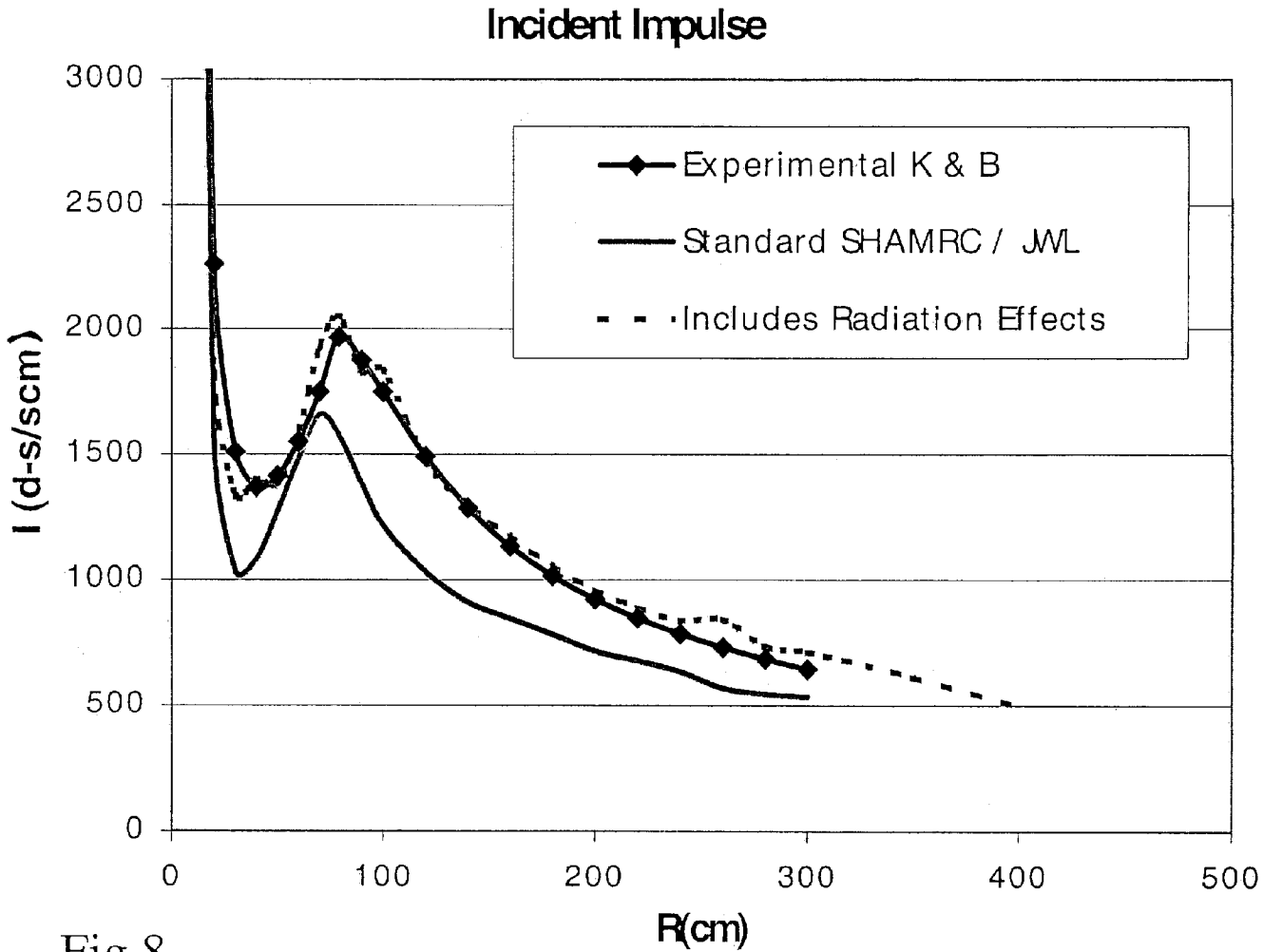
FIG. 8 is a graph showing the vastly improved agreement over the JWL that is achieved when an equation of state that includes the effects of delayed energy release and radiation heating of the air is used in the SHAMRC code.

At slightly larger ranges, this same JWL, cylinder-based EOS would be expected to under-predict the experimental air blast impulse because it had already expended its energy in the early stages. This behavior is observed in FIG. 7B. Moreover, the JWL EOS does not contain any of the effects of the radiation heating of the surrounding air. When both the delayed energy release and the radiation heating of the surrounding air are incorporated into the SHAMRC hydrocode, excellent agreement with the bare charge TNT air blast can be achieved, as shown in FIG. 8.

The results for TNT have been presented herein since TNT represents the most thoroughly investigated explosive to date.

However, this effect is not limited to TNT. In fact, the experiments yielding the data shown in FIG. 1 were all performed using Pentolite. Nonetheless, the TNT results are representative of the Pentolite results.

The foregoing descriptions and drawings should be considered as illustrative only of the principles of the invention. The invention may be implemented in a variety of systems and is not limited to the scenario of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A casing for a solid explosive munition comprising a casing wall for enclosing a munition, an inner surface of said casing wall including an optical reflecting layer that is highly reflective in the optical and infrared spectrum, said optical reflecting layer including a separate liner element and configured to increase explosive performance output of said munition by reflecting electromagnetic radiation generated by detonation of the munition.

2. The casing as set forth in claim 1, wherein said optical reflecting layer includes sheeting of at least one of metal, ceramic or plastic.

3. The casing as set forth in claim 2, wherein said optical reflecting layer includes sheeting of a reflecting metal having a low emissivity.

4. The casing as set forth in claim 3, wherein the reflecting metal is selected from the group consisting of aluminum, lead, steel, tungsten, nickel and gold.

5. An encased solid explosive munition device comprising a casing and a charge enclosed by said casing, an inner surface of said casing including an optical reflecting layer that is highly reflective in the optical and infrared spectrum, said optical reflecting layer including a separate liner element and configured to reflect electromagnetic radiation generated by detonation of said munition device to increase explosive output performance.

6. The device as set forth in claim 5, wherein said optical reflecting layer includes sheeting of at least one of metal, ceramic or plastic.

7. The device as set forth in claim 6, wherein said optical reflecting layer includes sheeting of a reflecting metal having a low emissivity.

8. The casing as set forth in claim 7, wherein the reflecting metal is selected from the group consisting of aluminum, lead, steel, tungsten, nickel and gold.

9. The casing as set forth in claim 1, wherein said casing is generally cylindrical and includes longitudinally extending reinforcement members radially spaced along said casing wall, said reinforcement members made of a material stronger than a material of said casing wall.

10. An encased solid explosive munition device comprising a generally cylindrical casing and a charge enclosed by said casing, said casing having longitudinally extending reinforcement members being radially spaced along a casing wall and made of a material stronger than a material of said casing wall, an inner surface of said casing wall including an optical reflecting layer that is highly reflective in the optical and infrared spectrum, said optical reflecting layer configured to reflect electromagnetic radiation generated by detonation of said munition device to increase explosive output performance.

* * * * *